US006722373B2

(12) United States Patent
Bowen et al.

(10) Patent No.: US 6,722,373 B2
(45) Date of Patent: Apr. 20, 2004

(54) CIGARETTE SIDESTREAM SMOKE TREATMENT MATERIAL

(75) Inventors: Larry Bowen, Orangeville (CA); Stanislav M. Snaidr, Mississauga (CA); E. Robert Becker, Wayne, PA (US); Warren A. Brackmann, J. Collins, MO (US)

(73) Assignee: Rothmans, Benson & Hedges Inc., Ontario (CA)

( * ) Notice: Subject to any disclaimer, the term of this patent is extended or adjusted under 35 U.S.C. 154(b) by 0 days.

(21) Appl. No.: 10/287,674

(22) Filed: Nov. 5, 2002

(65) Prior Publication Data

US 2003/0116169 A1 Jun. 26, 2003

Related U.S. Application Data

(63) Continuation of application No. 09/922,637, filed on Aug. 7, 2001, which is a division of application No. 09/292,751, filed on Apr. 16, 1999, now Pat. No. 6,286,516, which is a continuation-in-part of application No. 09/061,222, filed on Apr. 16, 1998, now abandoned.

(51) Int. Cl.[7] ..... A24D 1/02; A24D 1/12

(52) U.S. Cl. ..... 131/365; 131/349; 131/73; 162/139; 162/181.4

(58) Field of Search ..... 131/363, 349, 131/77, 73; 162/139, 158, 159, 181.1, 181.4, 181.5, 181.6, 181.8; 8/115.51

(56) References Cited

U.S. PATENT DOCUMENTS

| | | | | |
|---|---|---|---|---|
| 1,211,071 A | | 1/1917 | Brown | |
| 1,862,679 A | | 6/1932 | Holsman | |
| 2,755,207 A | * | 7/1956 | Frankenburg | 131/15 |

(List continued on next page.)

FOREIGN PATENT DOCUMENTS

| | | |
|---|---|---|
| CA | 604895 | 9/1960 |
| CA | 835684 | 3/1970 |
| CA | 1239783 | 1/1988 |
| CA | 1259008 | 9/1989 |
| EP | 0107471 | 5/1984 |
| EP | 0251254 A | 1/1988 |
| EP | 0304766 A | 3/1989 |
| EP | 0386884 A | 9/1990 |
| EP | 0658320 A2 | 6/1995 |
| EP | 0740907 A1 | 11/1996 |
| GB | 928089 | 6/1963 |
| GB | 1435504 | 5/1976 |
| GB | 2094130 | 9/1982 |
| WO | 95/34236 | 12/1995 |
| WO | 96/22031 | 7/1996 |
| WO | 98/16125 A | 4/1998 |

OTHER PUBLICATIONS

PCT/CA99/00334 International Search Report.

*Primary Examiner*—Dione A. Walls
(74) *Attorney, Agent, or Firm*—Banner & Witcoff, Ltd.

(57) ABSTRACT

A cigarette sidestream smoke treatment material made from a sheet of non-combustible active components provides a porous structure capable of treating sidestream smoke. The treatment material, as used in combination with a cigarette, provides a low sidestream smoke emitting cigarette unit. The material has a porosity which encourages a conventional free-burn rate of a conventional cigarette. The material may comprise a sorbent capable of sorbing components of the sidestream smoke, and an oxygen storage component which releases oxygen at free-burn rate temperatures to ensure that conventional free-burn rate is maintained and to enhance the oxidation treatment of the adsorbed non-aqueous components. Preferably, an oxidation catalyst is included in the material and most desirably the oxygen storage component may also function as the oxidation catalyst. Particularly preferred materials which perform the dual function are oxides of cerium.

47 Claims, 5 Drawing Sheets

U.S. PATENT DOCUMENTS

| | | | |
|---|---|---|---|
| 3,220,418 | A | 11/1965 | Cohn |
| 3,693,632 | A | 9/1972 | Tolman |
| 3,827,444 | A | 8/1974 | Khan |
| 3,886,954 | A | 6/1975 | Hannema et al. |
| 4,108,151 | A | 8/1978 | Martin et al. |
| 4,182,348 | A | 1/1980 | Seehofer et al. |
| 4,225,636 | A | 9/1980 | Cline et al. |
| 4,231,377 | A | 11/1980 | Cline et al. |
| 4,420,002 | A | 12/1983 | Cline |
| 4,433,697 | A | 2/1984 | Cline et al. |
| 4,450,847 | A | 5/1984 | Owens |
| 4,461,311 | A | 7/1984 | Mathews et al. |
| 4,561,454 | A | 12/1985 | Guess |
| 4,622,983 | A | 11/1986 | Mathews et al. |
| 4,624,268 | A | 11/1986 | Baker et al. |
| 4,637,410 | A | 1/1987 | Luke |
| 4,638,819 | A | 1/1987 | Ikeda |
| 4,685,477 | A | 8/1987 | Valdez |
| 4,805,644 | A | 2/1989 | Hampl, Jr. et al. |
| 4,878,507 | A | 11/1989 | Case et al. |
| 4,915,117 | A | 4/1990 | Ito |
| 4,915,118 | A | 4/1990 | Kaufman et al. |
| 5,040,551 | A | 8/1991 | Schlatter et al. |
| 5,105,838 | A | 4/1992 | White et al. |
| 5,137,034 | A | 8/1992 | Perfetti et al. |
| 5,159,940 | A | 11/1992 | Hayward et al. |
| 5,220,930 | A | 6/1993 | Gentry |
| 5,271,419 | A | 12/1993 | Arzonico et al. |
| 5,386,838 | A | 2/1995 | Quincy, III et al. |
| 5,540,242 | A | 7/1996 | Chao et al. |
| 5,592,955 | A | 1/1997 | Keritsis |
| 5,944,025 | A | 8/1999 | Cook et al. |

* cited by examiner

Raw Data at Centerline

CIGARETTE SIDESTREAM SMOKE TREATMENT MATERIAL

RELATED APPLICATION

This application is a continuation of Ser. No. 09/922,637 filed Aug. 7, 2001, which is a divisional of Ser. No. 09/292,751, filed Apr. 16, 1999, now U.S. Pat. No. 6,286,516, which is a Continuation-In-Part of Ser. No. 09/061,222, filed Apr. 16, 1998, now abandoned.

SCOPE OF THE INVENTION

A cigarette sidestream smoke treatment material made from a sheet of non-combustible active components provides a porous structure for treating sidestream smoke. The treatment material, as used in combination with a cigarette having conventional cigarette paper, provides a low sidestream smoke emitting cigarette unit. The material has a porosity which encourages a conventional free-burn rate of the cigarette. The material may comprise sorbent capable of sorbing components of the sidestream smoke and an oxygen storage component which releases oxygen at free-burn rate temperatures to ensure that conventional free-burn rate is maintained and to enhance the oxidation treatment of the captured non-aqueous components. Preferably, an oxidation catalyst is included in the material and most desirably the oxygen storage component may have as well the dual function of an oxidation catalyst. Particularly preferred compounds which perform the dual function are oxides of cerium.

BACKGROUND OF THE INVENTION

Smoking of tobacco products produce three types of smoke, namely mainstream smoke, exhaled smoke and sidestream smoke, particularly as it would relate to the smoking of cigarettes. Filter materials abound for use in removing sidestream smoke and exhaled smoke in somewhat confined areas where people might be smoking. It is generally understood that sidestream smoke accounts for the majority of smoke emitted during the smoking process. There has therefore been significant interest in reducing sidestream smoke and this might be accomplished by one or more of the following techniques:

i) alter the tobacco composition and packing characteristics of the tobacco rod charge in the cigarette or cigar;

ii) alter the cigarette paper wrapping of the cigarette or cigar;

iii) alter the diameter of the cigarette as well as its tobacco composition and/or provide a device on the cigarette or cigar to contain and/or control sidestream smoke emissions.

Various cigarette tobacco and cigarette paper formulations have been suggested which in one way or another affect the free-burn rate of the cigarette or cigar with a view to reducing sidestream smoke and/or achieving an extinguishment of the lit cigarette or cigar when left idle over an extended period of time. Such designs include a selection of tobacco blends, smaller cigarette diameters, densities and multiple layers of cigarette tobacco in the tobacco charge. Such selected designs can appreciably retard the free-burn rate of the cigarette and hence, increase the number of puffs obtained per unit length of cigarette. Either in combination with tobacco selection and/or construction or independently of the tobacco make up, various cigarette paper compositions can also affect free-burn rate of the cigarette. Such paper compositions include the use of chemicals to retard free-burn rate, chemicals to reduce sidestream smoke, multiple wrappings of different types of cigarette paper of the same or different characteristics and reduction of air permeability. See for example, Canadian Patents 1,239,783 and 1,259,008 and U.S. Pat. Nos. 4,108,151; 4,225,636; 4,231,377; 4,420,002; 4,433,697; 4,450,847; 4,461,311; 4,561,454; 4,624,268; 4,805,644; 4,878,507; 4,915,118; 5,220,930 and 5,271,419 and U.K. patent application 2 094 130. Cigarettes of smaller diameter have also been tried such as described in U.S. Pat. No. 4,637,410.

Various devices have been provided which contain the cigarette, primarily for purposes of preventing accidental fires. They may or may not at the same time include various types of filters to filter and thereby reduce the amount of sidestream smoke. Examples of such devices are shown in U.S. Pat. Nos. 1,211,071; 3,827,444; 3,886,954 and 4,685,477.

Further, various types of cigarette holders have been made available which serve the primary feature of minimizing staining of the smoker's fingers. Such devices may be connected to the cigarette tip and/or mounted on the cigarette, such as shown in U.S. Pat. No. 1,862,679. Other types of cigarettes which are enclosed in wrappers which are perforated in one way or another to provide for safety features and/or control of sidestream smoke are described in Canadian Patent 835,684 and U.S. Pat. Nos. 3,220,418 and 5,271,419

Devices which are mountable on the cigarette and which may be slid along the cigarette to control rate of combustion and hence free-burn rate are described in U.K. patent 928,089; U.S. Pat. No. 4,638,819 and International application WO 96/22031. The U.K. patent describes a combustion control device for cigarettes by limiting the flow of air to the cigarette burning ember. By retarding combustion of the cigarette, it is suggested that only half of the conventional amount of tobacco need be incorporated in the cigarette and result thereby in a shorter cigarette. The air flow limiting device may be provided by an array of apertures in the device with variable opening or by crimped portions in the device providing longitudinal openings along part of the cigarette. U.S. Pat. No. 4,638,819 describes a ring which is placed on the cigarette and slid therealong during the smoking process to control the free-burn rate of the cigarette and reduce sidestream smoke. The ring is of solid material, preferably metal, which causes considerable staining and due to variable cigarette diameters cannot reliably provide the desired degree of sidestream smoke reduction and extinguishing times.

An alternative ring system is described in applicant's published PCT application WO 96/22031. The device is provided with an inner ring which surrounds and contacts a conventional cigarette perimeter where the inner ring is of porous material. The outer ring encases the inner ring to direct air flow along the length dimension of the porous inner ring. The tortuous paths in the porous material of the inner ring controls the rate of air diffusion to the lit cigarette coal and thereby controls with the objective to reduce the free-burn rate of the cigarette. The porous material enhances the control of sidestream smoke emitted by the lit cigarette. The device may optionally extend up to one-half the length of the cigarette where air would have to flow along the inner porous ring to the burning coal.

Other systems which have been designed to control sidestream smoke are described in published PCT application WO 95/34226 and U.S. Pat. No. 4,685,477 issued Aug. 11, 1987; U.S. Pat. No. 5,592,955 issued Jan. 14, 1997 and U.S. Pat. No. 5,105,838 issued Apr. 21, 1992. These references describe various tubular configurations in which a tobacco element is placed in an attempt to minimize cigarette sidestream emission.

Various types of ceramic constituents have been used in cigarette structures including insulating tubes for cigarettes as well as insulating tubes for cigarette smoke aerosol generating devices. U.S. Pat. No. 4,915,117 describes a thin sheet of ceramic which is substituted for cigarette paper to reduce organic substances given off during the burning of conventional cigarette paper. Insulated ceramic sleeves are described in U.S. Pat. Nos. 5,105,838 and 5,159,940. U.S. Pat. No. 5,105,838 describes a cigarette unit having a thin tobacco rod of a circumference of about 12.5 mm. The insulating ceramic sleeve has low heat conductivity and is porous. In order to achieve reduction in sidestream smoke emissions from the burning tobacco rod, the free-burn rate is reduced by the use of a low porosity wrap over the porous ceramic element where the wrap has a permeability less than about 15 Coresta units.

U.S. Pat. No. 5,592,955 describes a porous shell which is re-usable and non-combustible for concealing and retaining a rod of smokeable material before, during and after smoking. Reduction of sidestream smoke emitted from this device is provided by an outer wrap for the shell which has a permeability of less than 40 Coresta units where the shell has a radial thickness of about 0.25 mm to 0.75 mm. The wrap controls the overall porosity of the device and thereby controls free-burn rate of the cigarette and reduces sidestream smoke developed during intervals between puffs. The device includes an air permeable cap at the open end of the tube. The non-combustible shell may include bands of metal which act as heat sinks to reduce the free-burn rate of the tobacco rod.

Catalytic materials have been used in smoking devices such as in the tobacco and particularly in cigarette smoke filters to convert mainstream smoke constituents usually by oxidation as taught in U.S. Pat. No. 3,693,632, U.K. Patent 1 435 504 and published EP patent applications 107 471 and 658 320. Catalysts have also been included in cigarette papers for wrapping tobacco such as described in Canadian Patent 604,895 and U.S. Pat. Nos. 4,182,348 and 5,386,838. Adsorptive materials, such as zeolites have been incorporated in the tobacco as well as the cigarette filter. Zeolites adapted for this use are described in published European patent application EP 740 907, where such zeolites have pore sizes within the range of 5 to 7 Å.

Although these various devices have met with varying degrees of success in controlling sidestream smoke emissions from a burning cigarette, the various embodiments of this invention provide a highly porous sidestream smoke treatment material which is capable of treating cigarette tobacco sidestream smoke in a surprisingly superior manner while the cigarette is permitted to burn at conventional free-burn rates.

In order to facilitate the description of this invention the term tobacco rod or tobacco charge shall be used in referencing cigarette, cigars, cigarillo, tobacco rod in a wrapper, a tobacco plug, wrapped tobacco or the like. It is also understood that when the term cigarette is used, it is interchangeable with cigar, cigarillo and other rod shaped smoking products.

SUMMARY OF THE INVENTION

Accordingly, the invention provides in an aspect thereof the use of a treatment material in a process for treating cigarette sidestream smoke to remove visible smoke particles, aerosols and convert gases with off odours.

According to another aspect of the invention, a low sidestream smoke emitting cigarette unit comprises:

i) a cigarette with conventional cigarette paper surrounding a tobacco rod of the cigarette;

ii) a non-combustible material for treating sidestream smoke, surrounding and being substantially in contact with the conventional cigarette paper of a tobacco rod portion of the cigarette; the material having a porosity which encourages a conventional free-burn rate for the cigarette within the material;

iii) the material comprises an oxygen storage component which releases oxygen at free-burn rate temperatures adjacent a burning coal of the cigarette whereby such released oxygen:

a) compensates for the material reducing rate of oxygen diffusion to a burning coal to ensure the conventional free-burn rate, and b) contributes to the oxidation treatment of components of sidestream smoke.

According to another aspect of the invention, a cigarette unit comprises:

i) a cigarette with cigarette paper surrounding a tobacco rod of the cigarette;

ii) a non combustible material surrounding and in substantial contact with an outer periphery of the cigarette paper, the material having a porosity which encourages a free-burn rate characteristic of the cigarette;

iii) the material comprises a substantially hydrophobic sorbent capable of sorbing non-aqueous components of the sidestream smoke emitted from a burning coal of the cigarette, and an oxygen storage component which releases oxygen at temperatures found adjacent a burning coal of the cigarette whereby such released oxygen:

a) compensates for the material reducing rate of oxygen diffusion to a burning coal to ensure its free-burn rate, and b) contributes to the oxidation treatment of components of sidestream smoke.

According to another aspect of the invention, a cigarette unit comprises a cigarette and a treatment material surrounding and substantially in contact with cigarette paper of the cigarette, the treatment material having a porosity which encourages conventional free-burn rate of the cigarette and comprises an oxidation catalyst which facilitates oxidation treatment of sidestream smoke emitted from a burning coal of the cigarette, the cigarette paper decoupling the sidestream smoke treatment reaction from generation of mainstream smoke during cigarette puff.

According to a further aspect of the invention, a method of treating sidestream smoke emitted by a burning cigarette having a sidestream smoke treatment material surrounding and substantially in contact with cigarette paper of a cigarette, the material having a porosity which encourages a conventional free-burn rate for the cigarette and comprises a sorbent and an oxygen storage component which releases oxygen at free-burn rate temperatures adjacent a burning coal of the cigarette, the method comprises:

i) sorbing non-aqueous components of sidestream smoke emitted by burning the cigarette and holding the components;

ii) releasing treated volatiles which permeate the material and are invisible in atmosphere.

According to a further aspect of the invention, sheet material for application to a cigarette to reduce sidestream smoke, comprises a composition of substantially hydrophobic sorbent, sheet reinforcement and an oxygen storage component which releases oxygen at free-burn rate temperatures adjacent a burning coal of a cigarette, the sheet material having the characteristics of:

i) a porosity in the range of at least about 200 Coresta units;

ii) a pore size of about 50 Å to about 2 microns;

iii) a BET surface area for the composition greater than about 20 $m^2/g$;

iv) a density of about 0.3 to about 0.8 g/cc; and v) a sheet thickness of about 0.04 mm to about 1 mm.

BRIEF DESCRIPTION OF THE DRAWINGS

Preferred embodiments of the invention are shown in the drawings wherein.

DETAILED DESCRIPTION OF THE PREFERRED EMBODIMENTS

Figure 1:
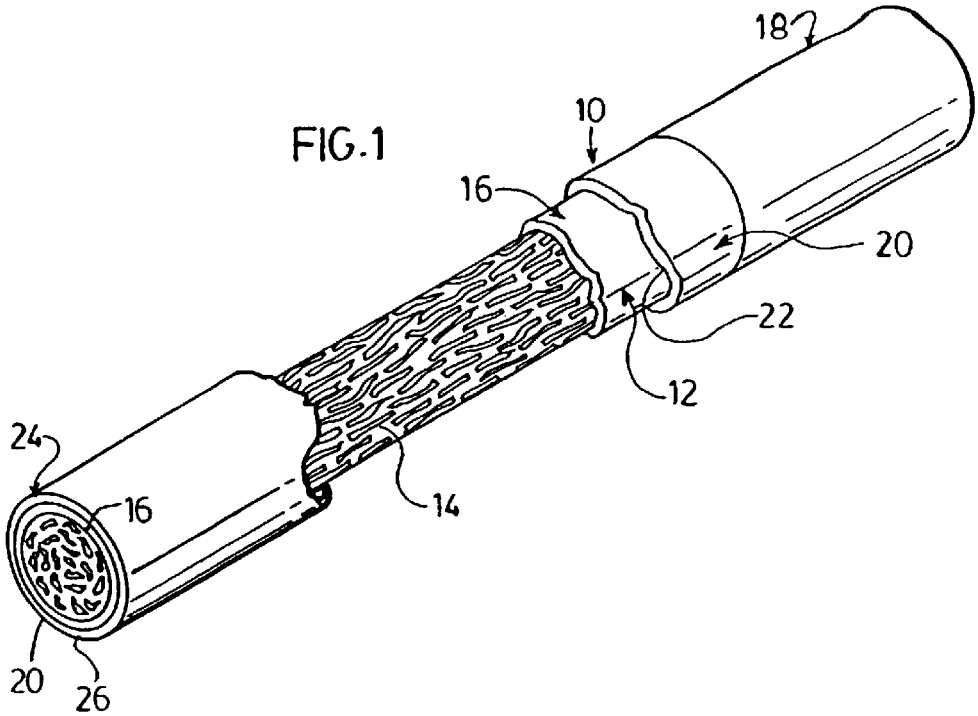
FIG. 1 is a representative perspective view of a cigarette unit in accordance with an embodiment of this invention showing an application of the treatment material.

The sidestream smoke treatment material as applied to tobacco smoke treatment in accordance with this invention provides a very significant unexpected advantage, particularly when applied to cigarette sidestream smoke. The treatment material may be in the shape of a tube placed on and in substantial contact with a cigarette or the material may be wrapped over and in substantial contact with a cigarette. Such arrangement permits the use of a conventional cigarette and when smoked, burns at conventional free-burn rates. Reference to a normal or conventional cigarette implies commercially available cigarettes having tobacco rods of conventional packing densities with conventional grades of tobacco, fillers, puffed tobacco and the like. The tobacco rod is encompassed in a conventional cigarette paper having the usual porosity in the range of about 5 to about 50 Coresta units and sometimes as high as 70 Coresta units. A conventional cigarette filter is either attached to the cigarette in the usual way, or alternatively, a filter may be provided in conjunction with the treatment material in tubular form which encases the tobacco rod with conventional cigarette paper. Conventional cigarettes have a conventional free-burn rate of about 3 to about 5 mm/min given conventional tobacco densities of about 0.20 to about 0.26 g/cc. Conventional cigarettes, at least in North America, have a circumference of about 20 to 30 cm, usually about 23 to 27 mm and a tobacco rod length of at least about 40 mm and preferably of about 55 mm, about 64 mm and about 74 mm, which has acceptable draw resistance. The cigarette filter usually has a length of about 15 to about 35 mm.

It is understood that a non-conventional cigarette is anything other than a conventional cigarette. Such non-conventional cigarettes may have modified tobaccos or modified cigarette papers which, for example, can affect free-burn rate, such as those described in the aforementioned patents.

The cigarettes may be tailor made smokeable cigarettes or may be the non-smokeable type of tobacco rod. According to one aspect of the invention, the non-smokeable type are rendered smokeable when cigarette paper is applied thereto to form a smokeable cigarette or the paper is on the inside of the treatment material in the form of a tube and the tobacco rod is inserted therein.

The treatment material in view of its proximity to the burning coal is able to provide sidestream smoke control in a very compact structure. Previously, cigarette units which provided for conventional free-burn rate were extremely bulky due to a large cavity defined within a tube which was spaced from the cigarette and did not in any way resemble a normal or conventional size cigarette. Attempts to control sidestream smoke with more compact conventional sized units usually resulted in the use of thinner cigarettes so as to provide a space between tube and cigarette. This might necessitate the smoker having to change brands in order to use the device and can also change the taste and flavour of the cigarette.

The treatment material of this invention has the advantage, particularly in respect of cigarettes, which allows a smoker to use the cigarette of their choice in the tubular structure or buy their favourite cigarette wrapped in the material of this invention. Although the treatment material may be used in conjunction with other forms of smoking products such as pipes and as well in filter devices for general filtration of tobacco smoke from air, the most significant application is in respect of cigarettes and cigars and other rod shaped smoking products. The treatment material may be wrapped onto cigarettes by standard cigarette making machines or the treatment material may be formed into a tube into which the cigarette is inserted where the tube interior contacts the cigarette. The tubular member permits smoking of conventional cigarettes in the usual customary way while providing conventional taste and flavour and minimal, if any, off odour. These features are particularly realized by allowing the cigarette to burn at its conventional free-burn rate. The treatment material is non-combustible, readily disposable and friendly to the environment since they may be made from inert materials such as ceramics, clays and other suitable binders and sheet reinforcement materials. Sheet reinforcement materials may be in the form of strands, flakes or filament like materials. The treatment material functions in a manner which allows conventional free-burn rate and hence, there is no requirement to control porosity in the tube to a particular minimal level nor is there a need for an outer wrapping on top of the treatment material to control porosity for the cigarette unit. The treatment material may be designed to have an external temperature which is relatively low and provides thereby higher safety characteristics. The unit is lightweight and at the open end is readily lit. Although not preferred, the tube may be adapted for reuse by permitting the cigarette to be reinserted in the tube in place of the cigarette that has been smoked.

The efficacy of the treatment material is enhanced by being very close to or placed in contact with a cigarette. The treatment material, by virtue of its construction, is most preferably positioned adjacent the burning coal of a cigarette to intercept, capture by adsorption or absorption or both, and treat various components of sidestream smoke which have left the burning coal and is clear of the cigarette paper. It is appreciated that only components which have sufficient affinity for the material are sorbed. Other materials, such as very volatile gases may pass through the material without being sorbed. However, such gases may be oxidized in the reaction zone of the material and in the presence of catalyst such oxidation reactions are expedited. The treatment material, either as applied to the surface of the cigarette or with a cigarette positioned therein, permits the cigarette to burn in the conventional manner without combustion of the treatment material It is appreciated however that the treatment material may be structured in a way that its structural strength is weakened during the smoking process to permit crushing of the cigarette before the smoker is finished.

Also with modifications, the tubular member could be used in conjunction with "roll-your-own" style of cigarettes which are normally sold in non-smokeable form but when inserted in the tube become smokeable. For example, the treatment material in sheet form could have cigarette paper applied to an inside surface thereof, formed into a tube and with the non-smokeable tobacco rod, such as, described in Canadian Patent 1,235,039, inserted into the tube, becomes a smokeable cigarette unit. Alternatively, porous wrapped filters of the cigarette unit could be covered with non-porous material to become smokeable. The treatment material may also be used on non-conventional cigarettes which, for example, may have modified cigarette papers which reduce free-burn of the cigarette. Although, cigarettes with reduced free-burn rates are not preferred, there may in certain circumstances be a need for such a cigarette unit, even though taste and flavour may be different.

In accordance with an embodiment of the invention, the first active component in the treatment material may be a substantially hydrophobic sorbent material capable of selectively sorbing non-aqueous components of the sidestream smoke emitted from a burning coal of the cigarette. The second active material is an oxygen storage component which releases oxygen at free-burn rate temperatures adjacent a burning coal. Such released oxygen performs at least the functions of i) compensating for the treatment material reducing rate of oxygen diffusion to a burning coal to ensure thereby the conventional free-burn rate; and ii) contributing to the oxidation treatment of components of the sidestream smoke.

The sorbtive material may be made from a variety of non-combustible components, as will be discussed in more detailed where the non-combustible components have significant porosities, large micropore sizes, very high BET surface areas, densities in the range of about 0.30 to about 0.80 g/cc and when made into sheets for purposes of use in the invention, are relatively thin ranging in thickness from about 0.04 mm to about 1 mm. The active sorptive components may individually have BET surface areas ranging from about 10 to about 1800 $m^2/g$ with pore size distributions ranging from about 5 Å to about 200 Å. The material usually has a pore volume of about 0.05 to about 1.0 $cm^3/g$. The material has interstitial spaces ranging in size from about 200 Å to about 2 microns.

The oxygen storage component is provided in situ of the material and/or applied to the surface of the material which is innermost when applied to a cigarette. The oxygen storage component is preferably a metal oxide having multiple oxidation states and is preferably selected from the group of transition metal oxides, rare earth metal oxides, lanthanide metal oxides and solid solutions of two or more metal oxides. The transition metal oxides may be selected from the group consisting of IVB, VB, VIB, VIIB, VIII and IB of the Periodic Table of Elements. The preferred oxygen storage components are oxides of the lanthanide metals and the most preferred are oxides of cerium. The oxygen storage material is capable of releasing oxygen at elevated temperatures, usually above 300° C. The donated oxygen functions most appropriately in the somewhat oxygen deprived environment around the burning coal. Although the very porous treatment material allows air to diffuse to the burning coal at a rate which encourages, for example, a conventional cigarette to burn at conventional free-burn rates, the treatment material will restrict to some extent the rate of air or oxygen diffusion through the material. Hence, the free-burn rate will be close to but may not be quite at the conventional free-burn rate. Hence, the oxygen donated by the oxygen storage material supplies sufficient additional oxygen to ensure a conventional free-burn rate. At the same time there is a competing reaction involving the oxidation of sorbed components of the sidestream smoke. The very porous treatment material feeds air to the oxidation reactions for oxidizing the sidestream components sorbed in said material. Hence, this reaction also competes for the oxygen donated by the oxygen storage material. However, the combination of the material having a highly porous structure and the oxygen storage component donating oxygen, provides sufficient oxygen to ensure that the cigarette burns at its conventional free-burn rate and that the oxidation of sorbed sidestream smoke components are at a suitable rate to ensure that visible components are not released from the material. Any components which might be visible on leaving the material to atmosphere are either further converted to non-visible components or are captured in the material by sorption.

Catalytic material may be readily incorporated into the treatment material in combination with the oxygen storage material. Although it is appreciated that the catalytic material may be incorporated in a suitable porous carrier without the presence of sorptive material or oxygen storage component. The catalyst may be provided in situ of the material and/or may be coated on the inside of the treatment material. The catalytic material is preferably an oxidation catalyst and may be of the type which may be used in conjunction with the oxygen storage component. The catalyst when provided in situ of the material, is present on the internal voids to convert sidestream smoke constituents, particularly off odour gases into acceptable odour gases which in turn may or may not depending on relative affinities, be released from the material. The catalyst and oxygen storage component may be combined or admixed and provided in situ of the tube and/or coated onto the surface of the material which is adjacent the cigarette when in use.

As discussed in applicant's co-pending international application PCT/CA97/00762 filed Oct. 15, 1997, the contents of which are herein incorporated by reference, a variety of catalysts may be used to promote various reactions in the cigarette sidestream smoke as at least some of the vapours passes through the material to, for example, reduce off odours, increase combustion of carbon monoxide and combustion of smaller molecules such as aldehydes, ketones, organic acids and the like. The preferred catalyst are from a group of oxidation catalyst. They generally include catalysts selected from the group consisting of platinum group of metals, transition metals and oxides thereof, rare earth metal oxides and lanthanide group of metals. The transition metal oxides having multiple oxidation states are preferably selected from the group consisting of group IVB, VB, VIB, VIIB, VIII and IB of the Periodic Table of Elements. The platinum group of metals preferably include platinum or palladium. Other catalysts include aluminum silicates, aluminum oxides and calcium carbonates. It is appreciated that the catalyst may include mixtures of the various catalysts or may include solid solutions of two or more metal oxides.

A useful group of aluminum silicate catalysts are the zeolites which may be exploited in this invention and may be of the type described in the aforementioned European patent application EP 740 907, the contents of which are hereby incorporated by reference. The aluminosilicate zeolites and high silica zeolites are capable of performing catalytic action in addition to their sorptive capacity. Preferred zeolites include Silicalite zeolites, X, Y and L zeolites, Beta zeolites, Mordenite zeolites and ZSM zeolites. It is understood that the hydrophobic zeolites have very high silica to alumina ratios of about 50 and higher. The selected catalyst or cocktail of catalysts may be incorporated in the sheet during its manufacture. Alternatively, the catalyst or mixtures thereof may be applied as a slurry or solution onto the developed porous structure and dried to provide catalyst on the internal surfaces of the pores.

It is also an aspect of the invention that the oxygen storage component may have the dual function of a oxidation catalyst. Certain transition metal oxides having multiple oxidation states can function both as an oxygen storage vehicle and as a catalyst facilitating oxidative functions. The preferred group of transition metal oxides having these capabilities are oxides of the lanthanide series of metals and most preferably are oxides of cerium. The amount of oxygen storage component and/or catalyst used in the treatment material can vary considerably depending upon the respective activities of the individual components or activities of the dual function component. Furthermore, the amounts will vary depending upon whether the catalyst is incorporated in situ of the material, applied as a coating to the inner surface of the material or used in both applications. As a guide, the catalyst material is present in an amount up to about 30% by weight of the material. The lower amount is of course dictated by the amount effective for purposes of oxygen storage component supplying oxygen as well as the amount necessary to perform effectively catalytic oxidation functions. Depending upon the activity of the selected material, the lower range for the catalytic material may be quite small in the parts per million, although normally will be greater than about 5% by weight. Some testing may be necessary to vary the lower amounts, particularly for the catalyst to ensure that oxidation is not expedited to the extent that the burning coal exceeds the conventional free-burn rate and hence begins to affect test and flavour of the mainstream smoke. Usually, the upper range for the oxygen storage component and/or catalyst is less than about 30% by weight and is preferably less than about 20% by weight. It is appreciated however that when selected materials have the dual function of oxygen storage as well as catalyzing oxidation reactions, the amount of the material may be higher than 30% by weight.

The preferred catalytic material is cerium based and in particular, cerium oxide. This catalyst not only functions very well in expediting oxidation of captured organic materials but as well performs the desired additional function of oxygen storage and release in oxygen deprived environments. The catalytic material in the form of cerium oxide ($CeO_2$) when in the cool state is capable of retaining oxygen but when elevated in temperature releases oxygen upon thermal conversion to ceric oxide ($Ce_2O_3$). As the burning coal advances along the tube of the treatment material, its temperature is elevated normally to a range of about 400 to 550° C., the catalytic material releases oxygen to maintain conventional free-burn rate of the cigarette. In addition, the released oxygen also supports the catalytic oxidation of the captured sidestream smoke components. It is appreciated that the cerium catalyst may be used in admixture with other catalyst or in solid solution with one or more metal oxides as a catalyst.

The treatment material is preferably made from sheet where the sheet may have a thickness normally in the range of 0.04 mm up to 2 mm but preferably not exceeding 1 mm in thickness. The sheet may be made by standard continuous papermaking processes without heat treatment or by processes involving heat treatment such as described in Ito, aforementioned U.S. Pat. No. 4,915,117, the subject matter of such process being incorporated herein by reference. A slurry composition is made up which includes the inorganic non-combustible active materials, non-combustible fillers and other combustible organic components. The slurry composition is formed into a precursor sheet which is then aged at an elevated temperature to evaporate the organics and develop thereby a porous structure for the sheet. The porous structure is usually constituted by a combination of macropores and micropores where the macropores intercommunicate through the sheet and are of a size which provides a porosity which encourages conventional free-burn rate of the cigarette. Accordingly, the porosity of the material should be greater than about 200 Coresta units and may go as high as 10,000 Coresta units or may be even higher. It is desirable for the Coresta value to be as high as possible where it is understood that physical properties of the material may limit porosity, for example, from about 300 to about 4000 Coresta units. When catalytic material is desired in the sheet material the catalytic particles may be added to the slurry composition in a catalytically effective amount up to about 30% by weight. The catalytic material is of a nature to withstand the heat treatment process and by virtue of its in situ location about the micropores and on the surfaces of the macropores, catalytic conversion of the adsorbed and absorbed sidestream smoke constituents is encouraged.

With reference to FIG. 1, a preferred embodiment of the application of the treatment material is shown as a cigarette unit 10. The cigarette unit is adapted by the treatment material to emit very low levels of sidestream smoke and preferably no visible sidestream smoke. The unit comprises a conventional cigarette 12 with a tobacco rod 14 which is wrapped in conventional cigarette paper 16. The unit includes a filter tipped portion 18 which co-operates with the tobacco rod 12 in providing the usual filtration of mainstream smoke. The treatment material may be used in accordance with an aspect of this invention in the shape of a tube 20 which surrounds or encompasses the cigarette 12. The tube 20, in accordance with this invention is in substantial contact with the exterior of the cigarette paper 16, as shown at juncture 22. The tobacco rod portion 14 preferably terminates at the end 24 of the tube where the tube thickness is generally shown at 26. The tube preferably has a radial thickness in the range of about 0.04 mm to about 1 mm. The overall outer diameter of the tube 20 will vary depending upon the diameter of the cigarette but can be designed in a way so as not to increase appreciably the overall size of the cigarette unit. Preferred circumferences for the cigarette unit range from about 25 mm to about 35 mm. This is very close to commercially available conventional cigarettes which have circumferences in the range of about 20 mm to about 30 mm. The filter portion 18 is also preferably of a diameter which is approximately the same as the outer diameter of the tube 20 so as to provide a finished looking cigarette unit.

The material wrapper or tube 20 may be characterized by:

i) a porosity in the range of at least about 200 Coresta units;

ii) a pore size of about 50 Å to about 2 microns;

iii) a BET surface area for the composition greater than about 20 $m^2/g$;

iv) a density of about 0.3 to about 0.8 g/cc; and v) a sheet thickness of about 0.04 mm to about 1 mm.

The tube porosity is sufficient to provide air flows to support conventional cigarette free-burn rate with the tube in contact with the cigarette burn zone to activate or alternatively enhance activity of tube material for treating sidestream smoke emitted from the burning coal. The porous structure is such that at elevated temperatures, its sidestream smoke absorptive and adsorptive characteristics are functional to sorb various sidestream smoke components for treatment and release. In addition, if a catalyst is present, the activity of the catalyst may be greatly enhanced at the elevated temperatures particularly in treating gases which tend to pass through the material without being sorbed or the surface of the sorbent. As well, the porous structure has sufficient sorptive capacity at the elevated temperatures to prevent breakthrough of sidestream smoke, particularly any visible aerosol particles. It is appreciated that the porous structure may be designed by virtue of altered thickness, altered pore size or the like to permit some sidestream smoke to permeate through the tube. This action may be desirable when the smell of a trace of sidestream smoke at the tube surface is desired by the smoker. The porous structure is designed preferably for one time use only and then discarded. This feature optimizes the design from the standpoint of tube thickness where a minimal thickness is required to prevent sidestream smoke breakthrough on a single use basis.

The skeletal density of the material will of course vary depending upon the type of materials incorporated. For example, aluminum oxides have a density of about 2.5 gm/cc, zirconium oxides of about 5.7 gm/cc and cerium oxide of about 7.3 gm/cc. The pore volume of the structure may be measured by nitrogen adsorption and mercury porosimetry techniques. This structure is capable of sorbing visible components of the sidestream smoke in the porous structure and in the presence of a suitable catalyst, converting any off odour gases which may pass through the material into acceptable odour gases as they permeate through the tube and are released to atmosphere.

In view of the material being useable on a normal or conventional cigarette, the cigarette isolates the tobacco from the tube. The paper preferably acts as a barrier to migration of constituents in the treatment material or sorbed sidestream smoke constituents into the tobacco so that mainstream smoke is not affected. The paper can be particularly useful in blocking diffusion of catalytic components into the tobacco to avoid thereby any off-taste in the mainstream smoke. The isolation of the treatment material from the tobacco rod by way of the cigarette paper performs unique functions peculiar to this invention. In respect of prior art devices which provide a tubular material on the cigarette, there is usually an additional paper material or the like applied to the exterior of the tube to provide the necessary control on oxygen diffusion to decrease free-burn rate and hence, give off less sidestream smoke. Contrary to this, applicant's invention provides a treatment material which allows the cigarette to burn at conventional free-burn rates and give off sidestream smoke in a normal manner including that generated by the cigarette paper. The treatment material then performs treatment on the sidestream smoke components externally of the cigarette paper in a manner decoupled from the activities of the burning coal in generating mainstream smoke. This decoupling of the treatment activities from the mainstream smoke production ensures that sidestream smoke components do not permeate back into the mainstream smoke to affect appreciably mainstream smoke flavour and taste nor introduce into the mainstream smoke a significant amount of constituents which are normally not there in smoking a cigarette freely. The sidestream smoke components may be sorbed by the treatment material, treated and then allowed to permeate outwardly to atmosphere. There is nothing in the physical structure of the treatment material which would direct the treated components and resultant reaction products back into the cigarette tobacco thereby avoiding any significant alteration to taste and flavour of the mainstream smoke.

In view of the treatment material being made in the form of a sheet, the tube thickness may comprise a single layer of the material, a composite of two or more layers for the sheet thickness or may comprise several layers of the sheet wrapped on themselves to develop the desired thickness for the tube. In view of the sheet material being thin it can be applied to a cigarette tobacco rod exterior by use of standard cigarette paper wrapping machines. Alternatively, tubes may be fabricated and in view of their overall structural strength may be individual devices, into which conventional cigarettes or non-smokeable cigarettes or other size of cigarettes may be inserted to provide for the desired sidestream smoke control. The tube is made of materials which are non-combustible and have a heat capacity which contributes to cigarette conventional free-burn rate by maintaining conventional cigarette temperatures about the burning coal. The tube does not require the presence of metallic components which act as heat sinks to control the burning coal temperature, instead, the tube in essence appears transparent to the burning coal so that conventional free-burn rates are maintained. Also, by virtue of the selection of the catalyst, oxygen storage may also be provided in the same material such that when the coal heats the tube, oxygen is released into the oxygen deprived environment adjacent the burning coal which further contributes to the support of the conventional free-burn rate of the cigarette.

Figure 2:
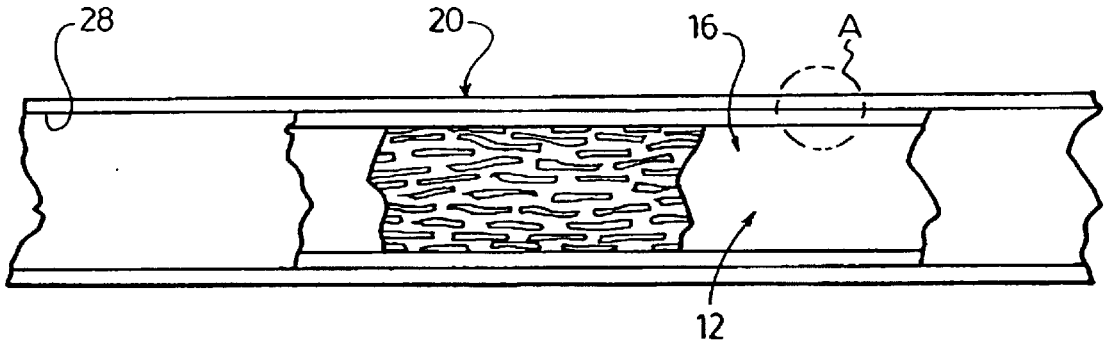
FIG. 2 is a partial section of the cigarette unit of FIG. 1.

FIG. 2 is a partial section of the cigarette of FIG. 1. The cigarette 12 with cigarette paper 16 is in contact with the interior 28 of the tube 20. This contact may be as a result of the sliding fit of the cigarette within the tube 20 or may be as a result of wrapping sheet material onto the cigarette to form the tube 20. As the cigarette is smoked, it recedes within the tube 20. Due to the unique characteristics of this treatment material, it is in essence able to accommodate this high temperature reaction zone as it advances along the tube. The structural strength of the tube may either be weakened by the advancing coal or if re-use is contemplated, the tube retains its structural strength.

Figure 3:
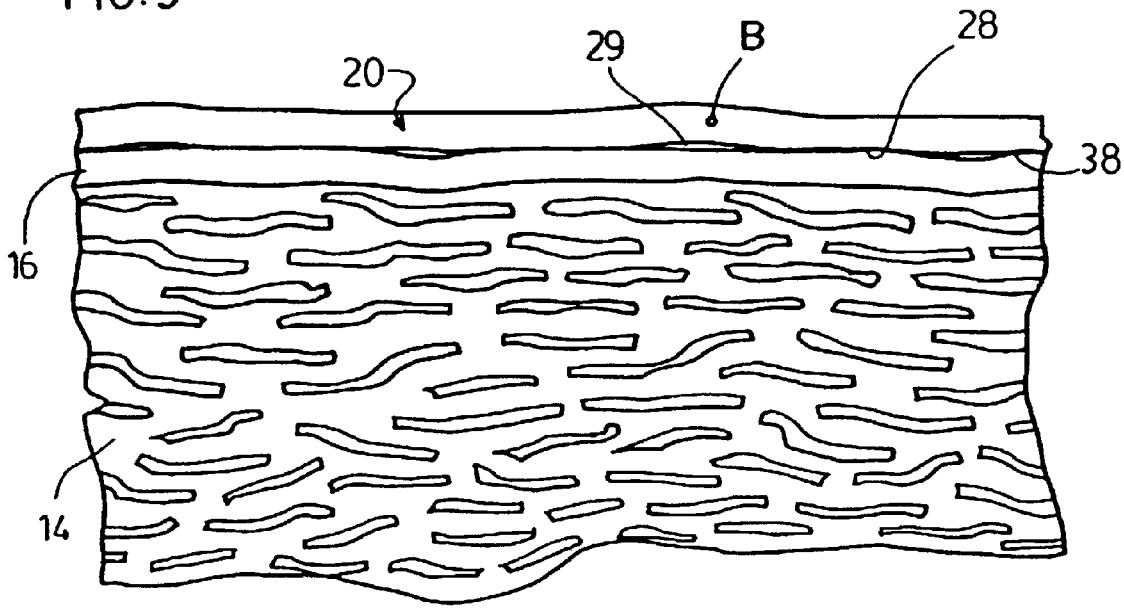
FIG. 3 is an enlarged view of portion A of FIG. 2.

FIG. 3 is the enlarged portion A of FIG. 2. The tube 20 is in substantial contact with the paper 16 wrapped about the tobacco 14. As previously noted, the tobacco density may be of the conventional packing densities and paper 16 may be of conventional paper so that no special adaptation is required in the cigarette manufacture to accommodate the use of the tube. It is appreciated however that in certain circumstances, the cigarette itself may have special packing densities and cigarette paper composition to further enhance reduced emissions of sidestream smoke, although in view of the overall efficacies of the treatment material, this would usually not be required. The interior surface 28 of the tube 20 is in contact with the majority of the exterior surface 38 of the cigarette paper 16 but as would be appreciated, small gaps or spaces 29 may exist along the cigarette between the paper and the wrapper material. As can be appreciated, these gaps are due to the cigarette paper which isolates the interior of the tube 20 from the tobacco 14, not defining an accurate cylinder nor is the interior of the wrapper exactly cylindrical.

Hence, the treatment material is considered to be substantially in contact with the cigarette paper.

In accordance with this invention, the tube is sufficiently close to the burn zone of the cigarette, and preferably as shown in FIG. 3, adjacent or in contact with a burn zone at the cigarette paper 16 to activate the porous structure of the tube. Although the tube material may have sorptive capacity at lower temperatures, the selected material can become catalytic at the much higher burn zone temperatures. The tube material is highly porous, well in excess of cigarette paper porosity which is usually about 50 Coresta units or less. The tube on the other hand has a porosity well in excess of this. The tube porosity is usually greater than 300 Coresta units and usually up to or beyond 4000 Coresta units. Such porosity ensures or encourages conventional free-burn rate of the cigarette. However, the pore size for the tube structure is such to ensure the required sidestream smoke sorptive capacity is provided, yet supply the needed air flows to support free-burn rate where the air flows may be supplemented by oxygen released by the storage component when heated.

Figure 4:
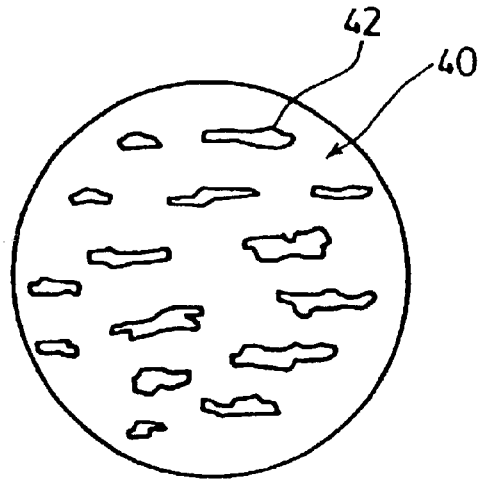
FIG. 4 is enlarged portion B of FIG. 3.

As shown in FIG. 4, exceptionally enlarged portion B of the tube 20 shows the structural material 40 with the macropores 42 having pore sizes preferably in the range of about 200 Å to 2 microns. It is appreciated that this section would be representative of no more than approximately 3 to 6 microns of the material. Branching off of the macropores 42 would be the micropores which have a pore size preferably in the range of about 5 to about 200 Å. The macropores 42 intercommunicate amongst one another to provide gas passage through the thickness of the tube. It is appreciated that the tube being a three-dimensional structure results in various orientations of the macropores where they overlap or intersect to provide this degree of communication. Communication is such to provide the desired porosity in the range of about 300 to about 4000 Coresta units and perhaps up to 10,000 Coresta units for the desired thickness of the tube where the BET surface area is preferably in the range of about 20 to about 1000 $m^2/g$. Depending on the choice of sorptive materials the BET surface area may be less than 500 $m^2/g$ and in some instances be less than 300 $m^2/g$. The macropores are of a size which clearly permit air to permeate inwardly through the tube 20 to supply oxygen to the burning coal within the tube. The sheet material may be made up from a variety of sorptive materials or they may be created in situ by heat treatment. For example, the sorptive materials may be activated carbon, zeolites or porous metal oxides. The activated carbon usually has a BET surface area of about 300 to about 1800 $m^2/g$ and a pore size distribution of about 5 Å to about 200 Å. The zeolites as used in this invention have a BET surface area of about 300 to 1000 $m^2/g$ and a pore size distribution of about 5 Å to about 20 Å. The porous metal oxides which are made by heat treatment, as discussed above, have a BET surface area of about 10 to about 400 $m^2/g$ and a pore size distribution of about 5 Å to about 20 Å. The sheet material generally has a pore volume of about 0.05 to 1.0 $cm^3/g$, and has pore openings in the interstitial spaces ranging in size from about 200 Å to about 2 microns.

The sidestream smoke from the burning coal permeates through the macropores, where the temperature of the tubular material rapidly decreases from the interior surface which may be in the range of 400 to 550° C. to the exterior surface which has dropped down to about 250 to 350° C. The vapours and aerosols condense on the surfaces of the porous structure and due to the affinity of the organic constituent within the cigarette smoke, they rapidly permeate the micropores and are sorbed on the sorptive material. At higher temperatures of the treatment material, the sorbed components may be oxidized to other compounds and released. The porous structure preferably has a heat capacity which minimizes heat build up in the area of the tube interior to ensure that the cigarette burns at conventional temperatures to avoid creation of any off taste in the mainstream smoke. As previously noted, the cigarette periphery temperature is in the range of 400 to 550° C. and the centreline temperature at the coal is about 700° C. to 950° C.

The treatment material surprisingly performs very efficient filtration of the sidestream smoke by intercepting sidestream smoke immediately outside of the cigarette paper. Gaseous products which may pass through the macropores without condensing and/or being adsorbed in the treatment material, may or may not include off odour gases, although as previously discussed, catalytic materials may be incorporated in the tubular unit to catalytically convert gases passing through the material so that the gases are converted to non-visible components when they exit the material or are eliminated. Also, as previously mentioned, the catalytic material having oxygen storage capabilities releases oxygen as it is heated by the adjacent burning coal. The released oxygen flows directly to the burning ember to further support conventional free-burn rate of the cigarette. Due to the relatively higher heat conductivities of the treatment material, the instantaneous temperatures in the region of the burning coal may be sufficiently high to effect in addition to catalytic conversion of various sidestream smoke components, the pyrolysis of organic materials. Such pyrolysis is capable of converting at least some of the captured organics into ash and colourless gases.

In accordance with an embodiment of the invention, the sheet material may be made from a slurry comprising ceramic sheet reinforcement materials of about 0.5 to 20 micron thickness, may be in the form of strands, flakes or filament like materials, held in a binder containing, for example, inert clays, aluminum silicate, magnesium silicate, cellulose materials, plastic and the like. This precursor sheet is dried and heat treated at a temperature in the range of 300° C. to 800° C. This elevated temperature burns off the organic materials including the cellulosic materials and plastics to develop the porous structure. Such heat treating also converts the binder material into a structure which develops the micropores. Preferably the materials are selected so as to provide a hydrophobic structure where the macropores permit water vapour to pass therethrough. In manufacturing the sheet precursor, in addition to catalytic particles, other catalytic or adsorptive materials may be included such as zeolites, activated carbon and the like. Structural strength enhancers may also be included or on the contrary, components which weaken under elevated temperature may be included so as to permit crushing of the tube after smoking. When developing the sheet precursor, evaporative organic binder materials may be included. It is also appreciated that the sheet material does not necessarily have to be heat treated particularly if activated carbon is used as the sorptive material. Alternatively, the sheet material may be dried and used in its precursor state and the high temperature cigarette burn zone is relied on to convert the precursor material into the treatment material having the properties of this invention.

EXAMPLES

The efficacy of various embodiments of the invention for treating sidestream smoke is demonstrated in the following examples. It is not intended however that the following examples are in any way limiting to the breadth of the appended claims.

Example 1

Representative compositions for the treatment material may vary somewhat but are generally within the following ranges for the various components.

TABLE 1

| Component | % by Weight |
|---|---|
| Paper Reinforcement Materials | 15.5 |
| Filler Clay | 54.5 |
| Bonding Clay | 9.0 |
| Activated Carbon | 21.0 |
| Added Dual Function Oxygen Storage and Catalyst | 0 to 20.0 |
| Physical Characteristics | |
| Density | .480 g/cc |
| Porosity (Coresta units) | 670 |
| Sheet Thickness | 230 to 280 microns |

Example 2

There are several considerations in respect of the efficiency of a material for treating sidestream smoke. There must be a sufficient reduction in visible components of sidestream smoke that the smoker realizes a benefit from smoking a cigarette unit in accordance with this invention. The system for treating the sidestream smoke should not affect appreciably the flavour and taste of the mainstream smoke. Furthermore, the treatment material should not add anything into the mainstream smoke which would appreciably affect flavour and taste. The treatment material must also avoid off odour gases.

In order to evaluate the reduction in visible sidestream smoke, sample cigarettes were tested to evaluate relative to a control (a conventional cigarette), the reduction for visible sidestream smoke. The test is capable of detecting visible sidestream smoke and based on the percentage of smoke emitted by the control, give a relative value for emitted smoke from the treatment device of this invention. Below is Table 2 which provides the comparison and demonstrates that with the treatment materials of this invention it is possible to achieve up to 100% elimination of the visible sidestream smoke.

TABLE 2

Reductions in visible sidestream smoke were tested using visual evaluation relative to a conventional/control sample. Rating for a standard sidestream smoke was established, and sample assigned values relative to control:

| Test Legend | Numerical Values | Short Form |
|---|---|---|
| Normal | 8 | N |
| | 7 | |
| Medium | 6 | M |
| | 5 | |
| Low | 4 | L |
| | 3 | |
| Very Low | 2 | VL |
| Very very Low | 1 | VVL |
| Clear | 0 | CL |

TEST RESULTS:

| Time of Observation (min) | Sample #1 | Sample #2 | Sample #3 |
|---|---|---|---|
| 1 | VL | VVL | VVL |
| 2 | CL | CL | CL |
| 4 | CL | CL | CL |
| 6 | CL | CL | CL |
| 10 | CL | CL | CL |

By way of using a standard smoking machine and capturing mainstream smoke and sidestream smoke in separate filters and analyzing the contents in the filters in the standard manner by gas chromatography, applicant has been able to demonstrate minimal change in mainstream smoke composition compared to conventional cigarettes in the presence of a catalyst. This result clearly demonstrates that the cigarette paper is capable of decoupling the catalytic treatment of sidestream smoke from the process of generating mainstream smoke. Table 3, set out below, exemplifies these results. The ratio for sample to control indicates a very minor change in TMP from control to sample. A value of 1.0 means no change whereas the test demonstrated a ratio of 1.09 for TMP and 1.2 for tar so that there is a very minor increase in those components in mainstream smoke composition. Smoking tests indicate that the sample has essentially the same taste and flavour as the control. It is important to note in the sidestream smoke there are very significant drops in all of TMP, Nic, $H_2O$ and Tar. This clearly indicates that while the mainstream smoke is not really affected, the treatment material is very active in reducing the noted components in the sidestream smoke. This aspect is discussed in more detail with respect to Example 5.

TABLE 3

The ISO standardized smoke test measurements for Chang in Mainstream (MS) and Sidestream (SS) smoke composition.

| MEASUREMENTS | TPM* | NIC* | H2O | TAR |
|---|---|---|---|---|
| Sample | | | | |
| MS | 17.22 | 1.33 | 2.3 | 13.5 |
| SS | 7.7 | 0.54 | .93 | 6.23 |
| Control | | | | |
| MS | 15.83 | 1.34 | 2.43 | 12.07 |
| SS | 31.40 | 4.64 | 1.25 | 25.6 |
| Ratio Sample/control | | | | |
| MS | 1.09 | 0.99 | 0.98 | 1.12 |
| SS | 0.24 | 0.12 | 0.74 | 0.24 |

*TPM—Total Particulate Matter
*NIC—Nicotine

Example 3

The sidestream smoke treatment material is of a very high porosity, much greater than 200 Coresta units and preferably well above 1000 Coresta units. This material should allow or promote conventional burning of the cigarette to ensure that mainstream smoke has the same taste and flavour as a corresponding cigarette and that the sidestream smoke does not have any appreciable off odour. One aspect in demonstrating that the cigarette unit is functioning properly is to compare temperatures at the periphery of the cigarette and at the centreline of the cigarette before, during and after the puff phase, with or without the treatment material. The following Table 4 shows the results of those tests which have been conducted by a cigarette temperature monitoring device of the type described in Example 4. The results set out in Table 4 clearly demonstrate that there is little difference regarding the centerline temperature between a conventional cigarette and a cigarette burning within the treatment material. The conventional cigarette has a peripheral temperature of about 450° C. to 480° C. and centreline temperature of about 750° C. to 785° C. when burning in a conventional manner with no treatment material. The corresponding cigarettes in the treatment material all have comparable periphery and centreline burning temperatures. The peripheral temperature is almost identical in the range of about 445 to about 475° C. Correspondingly, the centreline temperature is in the range of about 730 to about 793°

C. The temperatures set out in the table are the upper temperature levels for centreline and periphery which are experienced by the cigarette as the burning coal passes through the monitored zone. In view of the sample temperatures being essentially the same as the control temperatures, it is apparent that the material has a high heat conductivity when in use, and does not function as an insulator. If the treatment material acted as an insulator the sample temperatures would be higher, particularly at the periphery. It should be noted that simulated samples of the prior art, namely U.S. Pat. No. 4,915,117 having ceramic paper and WO 95/34226 having cigarette in cavity of a tube have temperature levels which indicate non-conventional performance. This result has been confirmed by actual smoking. Both simulated samples 1 and 2 had unacceptable off-taste and flavour.

TABLE 4

Comparison of the Centerline Burning Temperature Between Test Samples and Commercial Cigarettes

| Sample | Average Temperature (° C.) Centerline | Peripheral |
|---|---|---|
| Control | | |
| #1 | 785 | 450 |
| #2 | 760 | 480 |
| #3 | 750 | 450 |
| Sample W/O Catalyst | 791 | 445 |
| Sample Coated on Inside | 793 | 475 |
| Sample Containing Catalyst And Coated on Inside | 730 | 450 |
| Simulated Sample 1- U.S. Pat. No. 4,915,117) | 500 | 275 |
| Simulated Sample 2- WO 95/34226) | 680 | 580 |

Example 4

Figure 5:
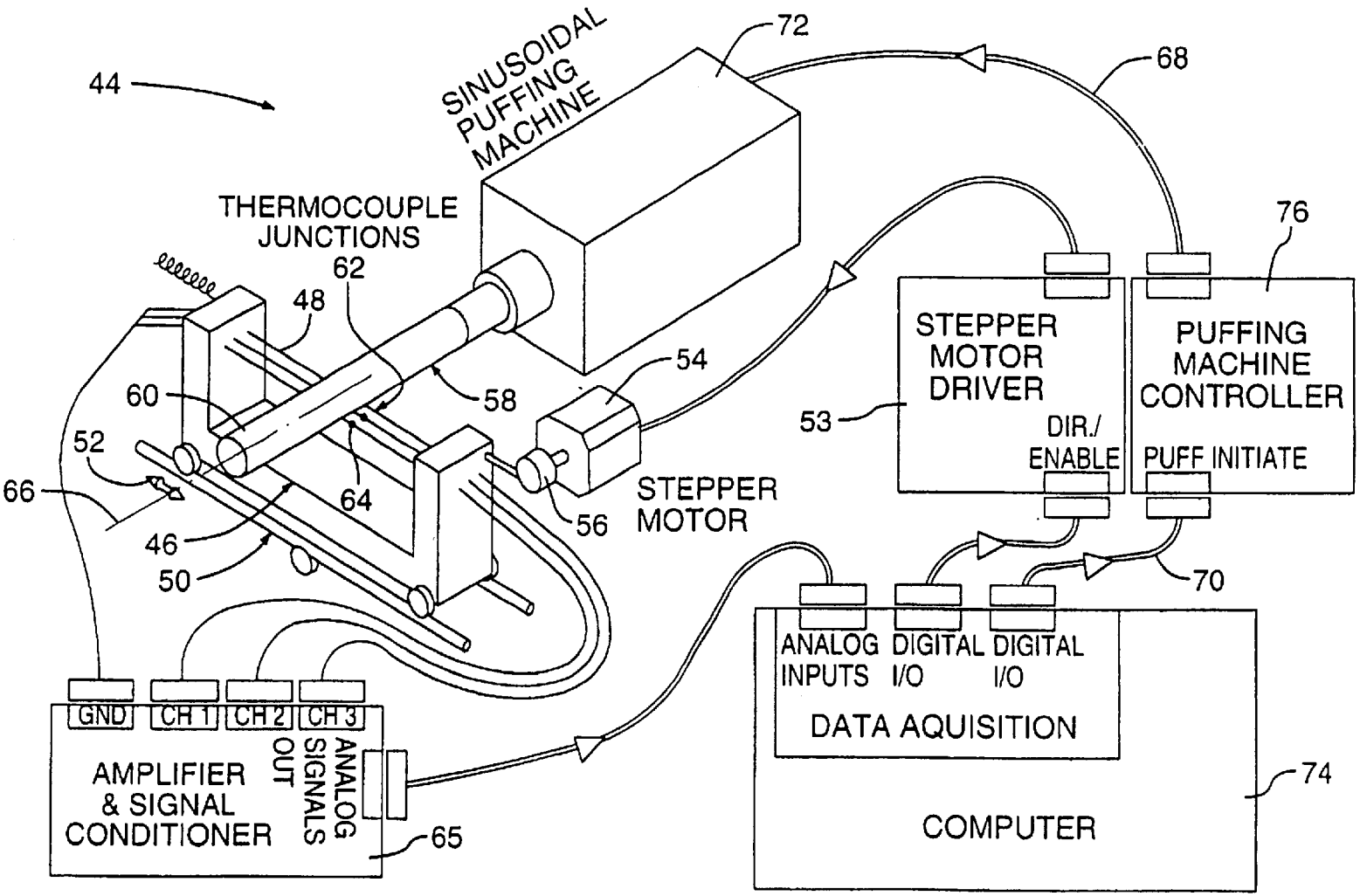
FIG. 5 is a schematic of an apparatus for measuring cigarette temperature.

It is difficult to reproduce accurately by machine test results that the taste and flavour of the cigarette is acceptable. A reliable temperature monitoring device has been developed to measure temperature on a periodic basis of about every 2 seconds. Before discussing the test results a brief description of the device of FIG. 5 is provided as follows.

The temperature measuring apparatus 44 comprises a frame 46 across which are stretched a number of fine (thermocouple) wires 48. These wires are parallel and typically 3 mm apart. The frame 46 is accurately constrained on track 50 to define a reproducible reciprocating motion of ~10 mm stroke in the direction 52 of the wires. A control 53 is for a computer-controlled motor 54 with a transmission 56 that converts rotary to linear motion and powers this translation. The sample cigarette 58 is stationary and fixed centrally within the frame 46 so that the wires 48 lie in the plane of and perpendicular to its axis. The wires 48 are threaded through the sample 58 using a fine needle so as to cause as little disturbance to the cigarette paper 60 as possible.

The thermocouples 62 consist of wires of two dissimilar metals. To accommodate the test temperature range, Type R (platinum-platinum/rhodium) is used, each wire having a diameter of 0.003". Each metal wire spans half the frame and is joined to the other metal wire at a welded junction 64. The junction thus formed is a sensitive temperature-to-voltage transducer. By control of the frame motion, this junction is caused to pass back and forth radially through the sample 58 from the axis 66 to just beyond its paper edge.

In one control scheme, the thermocouple junction 64 (hereafter 'TC') is moved in about 5 discrete steps, pausing at each for some 300 ms. This allows some time for the TC to stabilize before the reading is recorded.

The small TC voltages are conditioned, amplified and converted at unit 65 into temperatures.

The cigarette is connected at its filter to a conventional sinusoidal puffing machine. In our tests we have used an air volume of 36 ml in 2 seconds, occurring every 60 seconds. An electrical connection 68 and 70 between the puffing machine 72 and the recording/controlling computer 74 and 76 permits the device to distinguish temperatures taken during puffs from "standby" data. In this way, each TC records a radial scan every 2 seconds. As the coal of the sample burns through the TC, a characteristic time profile in the axial direction is also recorded.

Tests have shown that the coal moves at a substantially steady axial speed during the burn. Knowing this rate, we are able to convert the time data to effective axial position. In principle, a 3 dimensional plot of temperature as a function of both radial and axial position can be produced.

The difficulty comes in reading data during the puff. Since puffing occurs for a short time and infrequently, data are sparse. In fact only one small spike at a random position on the standby data is observed on any one TC. This problem has resulted in the need to use a multi-thermocouple technique, as shown in FIG. 5. Since, as explained, the time data can be converted to axial position and the distance between TCs is known, the individual TC data can be superimposed. Since the puffs occur at a different position for each TC, an envelope can be created that describes the true temperatures during the puff. By superimposing the data from several samples this envelope starts to build a good picture of the temperature profile during puffing.

Figure 6:
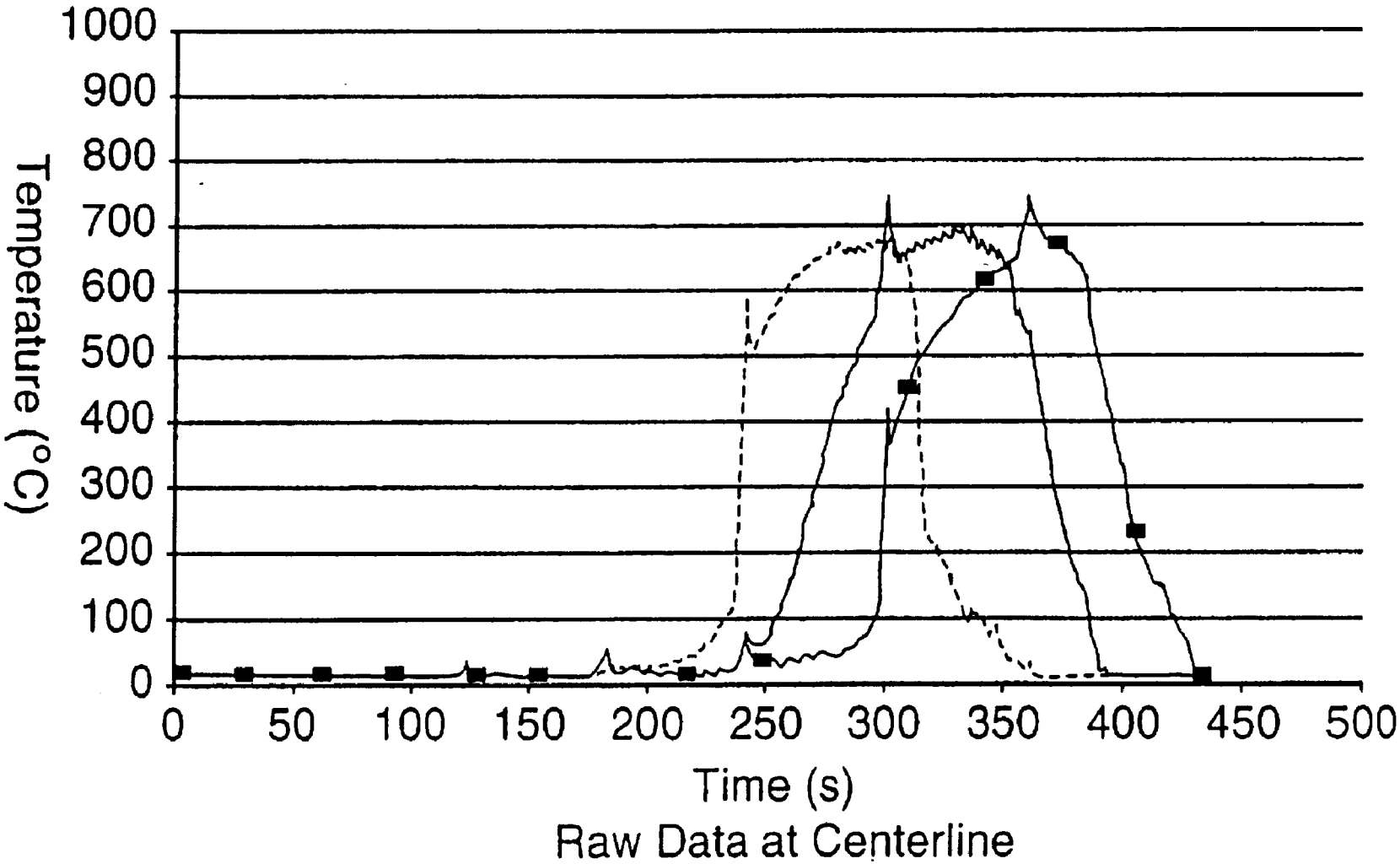
FIG. 6 is a graph of temperature versus time for measured tobacco temperatures during cigarette burn.
Figure 7:
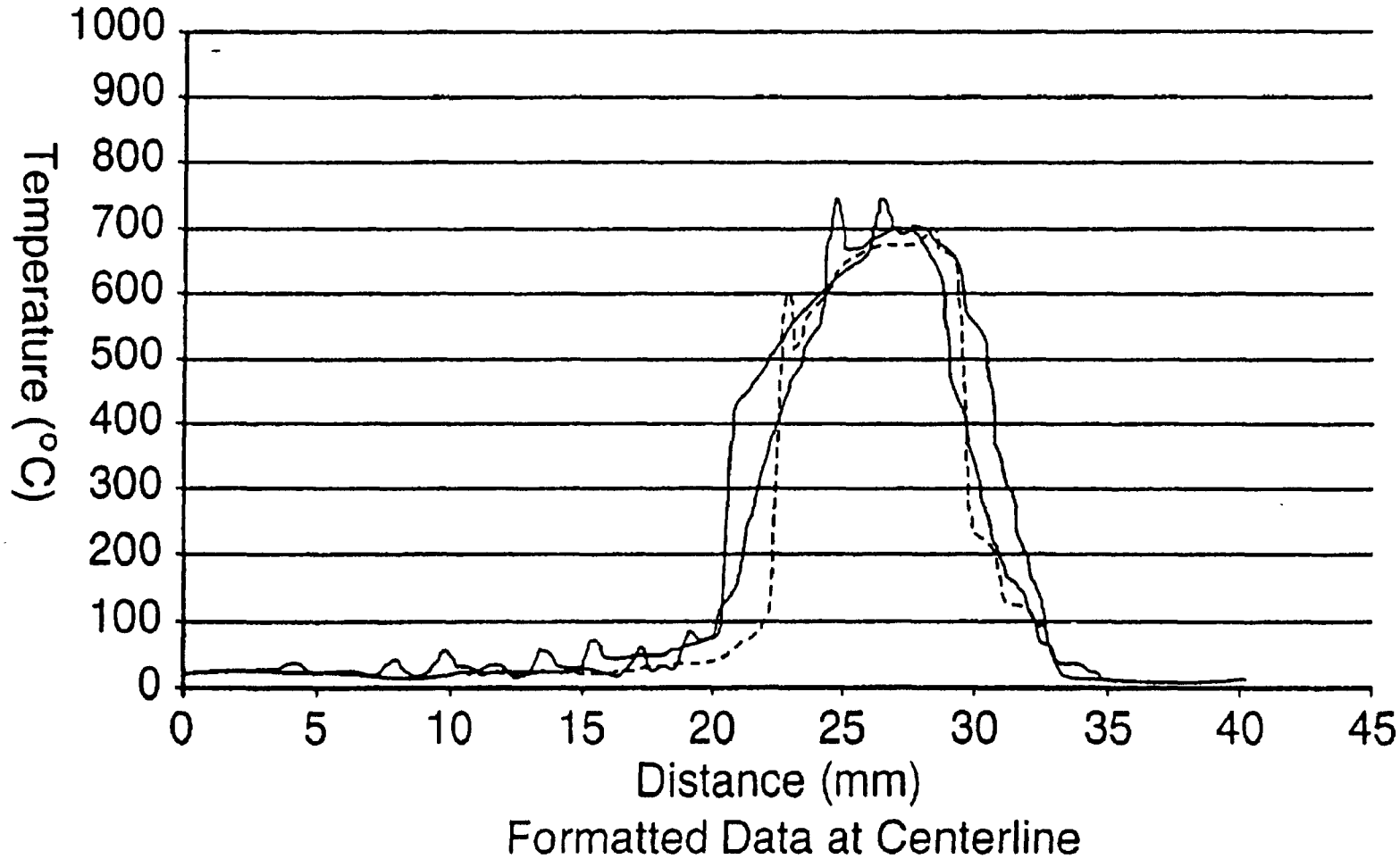
FIG. 7 is a graph of temperature versus distance for superimposed measured tobacco temperatures at centreline and periphery.

If one considers only data read at the centreline of the sample, the temperature vs. time graph resembles the graph of FIG. 6. Each thermocouple responds in turn as the coal passes through. Periodic spikes are noted during the puff. Note that these occur at regular intervals and simultaneously for each thermocouple. The rate of burning in mm/sec can be measured. This allows a conversion of the x-axis from time to distance. Since the distances between the thermocouples are known, one can superimpose their data. This produces a composite graph as shown in FIG. 7. Note that the small puff spikes are now scattered. As more data is composited from other samples, a puff "envelope" is defined.

The above temperature measuring device may be used to generate entire profiles in the form of graphs which show the history of the tobacco as the lit coal travels through that portion of tobacco. The critical part of the graphs which require analysis from the standpoint of taste and flavour are the leading sides of the curves which define the temperature of the tobacco as the burning coal approaches that location. The tobacco in this region as it warms up above 50° C. releases volatiles which have an impact on flavour and taste of mainstream smoke. The integrated area under the leading portion of the curve is predictive of the taste and flavour of the cigarette. The closer the curve is to the control, the more closely the taste and flavour will be to a conventional cigarette. Whereas the flatter the curve the less likely the cigarette will have taste and flavour like a conventional cigarette. The following Table 5 quantifies by way of an index number, the integrated area under the curve, where it can be seen that the preferred embodiments for the cigarette unit having cerium catalyst impregnated in the wrapper material and/or coated on the inside of the wrapper material, most closely resembles the conventional cigarette.

TABLE 5

Thermal History, Sample vs Control Cigarettes

| Sample # | Thermal History Index: Commercial Cigarette | Thermal History Index: Test Sample |
|---|---|---|
| 1 | 3.6 | |
| 2 | 4.3 | |
| W/O Catalyst | | 4.9 |
| Sample Containing Catalyst | | 4.7 |
| Sample Coated on Inside | | 3.3 |
| Sample Containing and Coated with Catalyst #1 | | 3.3 |
| Sample Containing and Coated with Catalyst #2 | | 4.1 |
| Simulated Sample #2 (WO 95/34226) | | 8.1 |

Actual smoking of the cigarettes also confirmed that this data correctly reflects that the cigarette unit has acceptable flavour and taste compared to conventional cigarettes. It should be noted that simulated Sample #2 was also evaluated for thermal history index. Its index is very high compared to the controls which confirms the off-taste and flavour from smoking tests on the simulated sample. The higher index indicates that the tobacco in advance of the burning coal is at a higher temperature for a longer period of time so that in essence the tobacco was being "cooked" in the cavity of the tube before the burning coal reached that portion of tobacco.

Example 5

The catalyst is provided in the wrapper material to facilitate oxidation of sidestream smoke components which may be sorbed in the material, treated and then possibly released depending upon the affinity of the treated material for the wrapper. The samples and controls were smoked in a standard smoking machine. The sidestream smoke emitted during smoking of the cigarette was captured in a suitable filter. The filter was then analyzed in the standard manner by use of gas chromatography to determine the presence of various organic compounds and the relative increase or decrease in the amount of those compounds in the captured sidestream for samples versus controls. The results set out in the following Table 6 demonstrates the activity of the catalyst in degrading various sidestream smoke components in comparing the sidestream smoke makeup for a conventional cigarette versus a cigarette unit of this invention. It is clearly apparent that several of the constituents in conventional sidestream smoke have been converted by the catalyst into lower molecular weight structures and which are inherently invisible should they permeate into the atmosphere. In addition, it is noted that some of the components such as bicylopentane, 2,3 dihydrofuran, 2 propanone, ethylbenzene, 1-decene and benzene, have been completely eliminated as indicated by a ratio of 0.

TABLE 6

Proportional Ratio of Side Stream Components Divided By the Control Sample Values for Selected Compounds

| COMPOUND | RATIO SAMPLE/CONTROL |
|---|---|
| 1,3 butadiene | 34 |
| Bicyclopentane | 0 |
| 2,3 Dihydrofuran | 0 |

TABLE 6-continued

Proportional Ratio of Side Stream Components Divided By the Control Sample Values for Selected Compounds

| COMPOUND | RATIO SAMPLE/CONTROL |
|---|---|
| Furan, 2-methyl | 25 |
| 2 propanone | 0 |
| Pyridine | 25 |
| Furfural | 19 |
| Ethylbenzene | 0 |
| P-xylene | 23 |
| l-decene | 0 |
| Benzene | 0 |
| D-limonene | 23 |

The examples demonstrate various features of certain aspects of the invention in treating and preferably eliminating sidestream smoke without appreciably affecting taste and flavour of mainstream smoke. The treatment material is most effective in eliminating visible sidestream smoke while at the same time contributing to the oxidation of sidestream smoke components. There is no unusual odour associated with the cigarette unit while burning which demonstrates the effectiveness of the treatment material.

Although preferred embodiments of the invention have been described herein in detail, it is appreciated by those skilled in the art that variations may be made thereto without departing from the spirit of the invention or the scope of the appended claims.

What is claimed is:

1. Sheet material for application to a cigarette to reduce sidestream smoke, said sheet material comprising substantially hydrophobic sorbent, sheet reinforcement and an oxygen storage component which releases oxygen at free-burn rate temperatures adjacent a burning coal of a cigarette, said sheet material having the characteristics of:

i) a porosity in the range of at least about 200 Coresta units ii) a pore size of about 50 Å to about 2 microns;

iii) a BET surface area for the composition greater than about 20 $m^2/g$;

iv) a density of about 0.3 to about 0.8 g/cc; and v) a sheet thickness of about 0.04 mm to about 1 mm.

2. Sheet material of claim 1 wherein said BET surface area is less than about 1000 $m^2/g$.

3. Sheet material of claim 1 wherein said BET surface area is less than about 500 $m^2/g$.

4. Sheet material of claim 1 wherein said BET surface area is less than about 300 $m^2/g$.

5. Sheet material of claim 1 wherein said sorbent is activated carbon having a BET surface area of about 300 to about 1800 $m^2/g$ and a pore size distribution of about 9 Å to about 40 Å.

6. Sheet material of claim 1 wherein said sorbent is a zeolite having a BET surface area of about 300 to about 1000 $m^2/g$ and a pore size distribution of about 5 Å to about 20 Å.

7. Sheet material of claim 1 wherein said sorbent is a porous metal oxide having a BET surface area of about 10 to about 400 $m^2/g$ and a pore size distribution of about 5 Å to about 20 Å.

8. Sheet material of claim 1 wherein said material has a pore volume of about 0.05 to about 1.0 $cm^3/g$.

9. Sheet material of claim 1 wherein said sheet reinforcement is in the form of strands, flakes or filament like materials.

10. Sheet material of claim 1 wherein said material has openings in interstitial spaces ranging in size from about 200 Å to about 2 microns.

11. Sheet material of claim 1 wherein said oxygen storage component is a metal oxide having multiple oxidation states.

12. Sheet material of claim 11 wherein said metal oxide is selected from the group consisting of transition metal oxides, rare earth metal oxides and lanthanide metal oxides.

13. Sheet material of claim 12 wherein said transition metal oxide is selected from the group consisting of IVB, VB, VIB, VIIB, VIII and IB of the Periodic Table of Elements, mixtures thereof and solid solutions of two or more metal oxides.

14. Sheet material of claim 11 wherein said metal oxide is selected from oxides of the lanthanide metals.

15. Sheet material of claim 14 wherein said metal oxide is an oxide of cerium.

16. Sheet material of claim 14 wherein said metal oxide is an oxide of cerium or a solid solution of cerium with another metal oxide.

17. Sheet material of claim 11 wherein said oxygen storage component has the dual function of an oxidation catalyst.

18. Sheet material of claim 17 wherein said oxygen storage component has a dual function as a catalyst selected from the group consisting of transition metal oxides having multiple oxidation states and lanthanide metal oxides.

19. Sheet material of claim 18 wherein said dual function oxygen storage component and catalyst is an oxide of cerium.

20. Sheet material of claim 17 wherein said dual function material is present in said material in an amount effective for said oxidation up to about 30% by weight.

21. Sheet material of claim 1 wherein said material additionally comprises a catalyst for promoting oxidation of said non-aqueous components.

22. Sheet material of claim 21 wherein said catalyst is selected from the group consisting of platinum group of metals, transition metal oxides, rare earth metal oxides, lanthanide metal oxides, aluminum silicates, aluminum oxides, calcium carbonates, mixtures thereof, and solid solutions of at least two of said metal oxides.

23. Sheet material of claim 22 wherein said catalyst is selected from the group consisting of zeolites, platinum, palladium and cerium.

24. Sheet material of claim 21 wherein said oxygen storage component and said catalyst is present in said material in a combined amount effective for said oxidation up to about 30% by weight.

25. Sheet material of claim 21 comprising multiple layers, wherein a first of said layers positionable adjacent cigarette paper is predominantly of said oxygen storage component, a second of said layers is predominantly said catalyst or said sorbent and a third of said layers is predominantly the other of said catalyst or said sorbent.

26. Sheet material of claim 1 wherein said oxygen storage component is present in said material in an amount effective for said oxidation up to about 30% by weight.

27. Sheet material of claim 26 wherein said oxygen storage component and/or said catalyst is present in the amount of about 5% to about 20% by weight.

28. Sheet material of claim 26 wherein oxygen storage material is additionally added to an interior surface of said material for positioning adjacent cigarette paper.

29. Sheet material of claim 1 wherein said material has a porosity of less than 10,000 Coresta units.

30. Sheet material of claim 29 wherein said material has a porosity of at least about 300 Coresta units.

31. Sheet material of claim 30 wherein said material has a porosity of less than 4000 Coresta units.

32. Sheet material of claim 1 wherein said material is capable of being wrapped onto cigarette paper to define a wrapper of material for said cigarette.

33. Sheet material of claim 1 wherein said material is multilayered.

34. Sheet material of claim 33 wherein said sorbent is activated carbon.

35. Sheet material of claim 33 wherein said sorbent is a zeolite having pore diameters sufficient to sorb non-aqueous components of sidestream smoke.

36. Sheet material of claim 35 wherein said zeolite has large pore sizing in the range of about 9 to 40 Å.

37. Sheet material of claim 35 wherein said zeolite is a Y zeolite.

38. Sheet material of claim 1 said sorbent material is selected from the group consisting of activated carbon, molecular sieves and porous metal oxides.

39. Sheet material of claim 38 wherein said porous metal oxide is prepared by heat treating a sheet material comprising metal oxides, sheet reinforcements and organics which are driven off during heat treatment at temperatures in the range of about 300 to 800° C., to provide a porous sheet material.

40. Sheet material of claim 1 wherein said material has a heat capacity which conducts heat away from a burning coal to provide a temperature at inside surface of said material adjacent a burning coal of said cigarette of about 400 to 550° C. and a centreline temperature adjacent a burning coal in said cigarette of about 700 to 950° C.

41. Sheet material of claim 1 wherein said sheet material as applied to said cigarette has a thickness in the range of about 0.04 mm to about 1 mm.

42. Sheet material of claim 1 wherein said material as applied to said cigarette has an outside surface which is unrestricted by any coating or additional paper wrap.

43. A method of making a cigarette unit comprising wrapping a sheet material of claim 1 about a cigarette having cigarette paper.

44. A method of claim 43 wherein said wrapped sheet material is connected at a lap seam and glued in place, said wrapper being free of any outer combustible covering.

45. A method of making a cigarette unit comprising simultaneously wrapping a sheet material of claim 1 and a cigarette paper onto a tobacco rod with said paper being innermost and adjacent said tobacco rod.

46. A method of claim 45 wherein said cigarette paper has a conventional porosity in the range of about 5 to about 70 Coresta units.

47. A method of making a cigarette unit comprising forming a tube of said material of claim 1 with a cigarette paper on an inside surface of said tube, said tube having an internal diameter sized to receive a non-smokeable cigarette tobacco rod which becomes smokeable when inserted into said tube.

* * * * *